US005235490A

United States Patent [19]

Frank et al.

[11] Patent Number: 5,235,490

[45] Date of Patent: Aug. 10, 1993

[54] TRIGGER CIRCUIT FOR AN ELECTROMAGNETIC DEVICE

[75] Inventors: Bruno Frank, Möglingen; Martin Müller, Asperg; Helmut Rembold, Stuttgart, all of Fed. Rep. of Germany

[73] Assignee: Robert Bosch GmbH, Stuttgart, Fed. Rep. of Germany

[21] Appl. No.: 707,450

[22] Filed: May 30, 1991

[30] Foreign Application Priority Data

Jun. 8, 1990 [DE] Fed. Rep. of Germany ..... 4018320

[51] Int. Cl.[5] ..... H01H 47/04

[52] U.S. Cl. ..... 361/154; 361/152; 361/194; 361/196; 123/490

[58] Field of Search ..... 123/490; 361/152, 154, 361/160, 170, 187, 194, 195, 196, 197, 198

[56] References Cited

U.S. PATENT DOCUMENTS

| | | | |
|---|---|---|---|
| 4,148,090 | 4/1979 | Kawai et al. | 361/152 |
| 4,351,299 | 9/1982 | Costello | 361/152 |
| 4,385,339 | 5/1983 | Takada et al. | 361/154 |
| 4,726,389 | 2/1988 | Minoura et al. | 123/490 |
| 4,949,215 | 8/1990 | Studtmann et al. | 361/160 |

*Primary Examiner*—Jeffrey A. Gaffin
*Attorney, Agent, or Firm*—Kenyon & Kenyon

[57] ABSTRACT

A trigger circuit for an electromagnetic device, in particular a solenoid valve of an injection system for an internal-combustion engine, has a control element for causing excitation of the electromagnetic device to be lowered at least once and then raised after the electromagnetic device is activated. The control element has a delay circuit which slows down the rate at which excitation of the electromagnetic device changes during the lowering and/or raising action.

16 Claims, 9 Drawing Sheets

TRIGGER CIRCUIT FOR AN ELECTROMAGNETIC DEVICE

TECHNICAL FIELD

The invention relates to a trigger circuit for an electromagnetic device. More specifically, the present invention relates to a trigger circuit for a solenoid valve of an injection system of an internal-combustion engine, with the trigger circuit having a control element, which, after the device is switched on, causes the excitation of the device to be lowered at least once and subsequently raised once with the raising and lowering in excitation being accomplished at a controlled rate.

BACKGROUND OF THE INVENTION

Internal-combustion engines equipped with injection systems are known in motor vehicle technology. Self-ignitable internal combustion engines, in particular diesel engines, are also internal combustion engines with fuel injection systems. The operational performance of these engines is determined decisively by the injection process which may include, for example, injection quantity, time of injection, etc.

In order to exceed the nozzle opening pressure of an injection valve, it is known to pressurize the fuel that is to be injected into an internal combustion engine. This considerable pressure may be achieved using a high-pressure pump. When the fuel is pressurized, the nozzle needle of the injection valve opens, and the injection process begins.

To build up pressure, the high-pressure chamber of the high-pressure pump is sealed by a solenoid valve leading to a pressure-free chamber. If the injection process is to be ended before the pressure of the pressurized fuel falls below the closing pressure of the injection valve, the solenoid valve is opened which allows the pressure in the injection system to be reduced. The reduced pressure will cause the injection valve to close and the injection process to end.

It is known also, not to keep the solenoid valve constantly closed during the injection process, but rather to open it at least once briefly to a certain degree during the process and then reclose it. By opening and closing the solenoid valve in this manner, the fuel injection rate to influence the running of the engine may be adjusted.

In order to determine a defined beginning and end of injection process, a solenoid valve has very short switching times. An extremely effective control of the injection process results from control of the injection characteristic (opening and closing of the solenoid valve during the injection process), so that turn-on and turn-off time variances, which are dependent on the solenoid valve, have a drastic effect on the accuracy of metering the fuel.

Published German Patent Application 34 42 764 discloses a device for switching electromagnetic devices quickly. The apparatus described in this application has an electromagnetic device connected in series with a break device. A controllable capacitor is arranged parallel to the break device. The break device can be used for metering fuel in internal-combustion engines. The short switching times do in fact lead to a low power loss for the circuit arrangement, however, it may result in certain disadvantages. The apparatus discussed in this German application allows the load current to be operated in a fixed cycle. By switching the break device on and off, the load current is able to be lowered to a specific average value.

SUMMARY OF THE INVENTION

The present invention is a trigger circuit which is used in forming the injection characteristic. According to the present invention, the otherwise short switching times of the electromagnetic device, such as a solenoid valve, are prolonged so that the activation and deactivation of the solenoid value is delayed, resulting in a greater controlled change in excitation. Further, according to the present invention, the sensitivity of the trigger time $t_A$ for effecting the right opening and closing of the solenoid valve during the injection process, and the sensitivity of the solenoid-valve switching times with regard to the injection quantity, are reduced. That is, the turn-on and turn-off times of the solenoid valve for the closing interrupts are prolonged quasi—electrically. Electrically prolonged as it is used here is understood to mean that the triggering of the solenoid valve is modified in such a way that the reduction and/or build-up of the magnetic force is slowed down; therefore, the trigger-time response of the solenoid valve for the closing interrupt is evened out in comparison with known systems, so that the injection quantity can be exactly dosed and so that turn-on and turn-off time variances, which are dependent on the solenoid valve, only have a marginal effect on fuel metering accuracy. When looked at from the standpoints of noise, exhaust, and consumption, etc., the injection rate may be adjusted to provide for favorable running of the engine, without instabilities.

Since the action of the closing interrupt is only effective during the time of the injection process, the quick switching property of the solenoid valve can be used also to establish the beginning and end of the injection process. Accordingly, the longer switching times are only applied to form the injection characteristic.

The time to interrupt the current of a solenoid valve to form the injection characteristic amounts, for example, to 45 $\mu$s. This results in a partial opening (lift of approx. 13 $\mu$m) and a subsequent closing. Since the interrupt time for the solenoid valve current is very short, varying this trigger time by a few microseconds causes the interrupt stroke to change drastically. Accordingly, the volume of fuel flowing back from the injection line during the time that the solenoid valve is opened also varies, as does the total injection quantity. This may lead to fuel metering inaccuracies.

Prolonging the switching time accordingly to the present invention has been found advantageous. In particular, the trigger circuit makes it possible to control the pressure relief rate which is brought about by the closing interrupt, which depends upon the rotational frequency and other parameters of the internal combustion engine.

During the closing interrupt, two volumetric flows stream through the solenoid valve. First, there is the relief volume, which emerges from the injection nozzle, and second, the volume displaced further by the piston of the high-pressure pump during the time that the injection nozzle is opened. At a certain pressure drop in the injection system, the relief volume is measured. The displaced volume changes with the rotational frequency of the internal combustion engine. From this, a rule is derived which applies to the solenoid valve lifting during the closing interrupt. At high rotational speeds, a quick relieving action is needed with a fast opening and a sizable opening lift, as well as with a subsequent fast closing. To produce the desired injection characteristic at low rotational speeds, it is necessary to have a correspondingly slower opening and closing rate with a smaller opening lift when there is a longer opening time.

If the injection characteristic is formed by a pump-nozzle unit, then the characteristic of the closing-time interrupt must be adapted very precisely to changing rotational speeds. The configuration according to the present invention allows an optimum injection characteristic to be formed over the entire operating range of the internal combustion engine.

Therefore, according to the present invention, a delay circuit controls the solenoid valve during the injection process in such a way that its closed status, which is required to build up the pressure of the fuel to be injected, is interrupted by at least a closing interrupt with a slowed-down change in excitation. The closing interrupt brings about the formation of the injection characteristic. The present invention also provides for the solenoid valve to be in series with a controllable contact element, and for at least one controllable switching element to be situated between a gate electrode and a breaker-gap connection of the contact element, so that when the controllable switching element is switched through, the solenoid-valve current is reduced. This reduction takes place with a slowed current variation rate, thus bringing about the desired closing interrupt.

The controllable contact element and/or the controllable switching element are preferably designed as transistors. The delayed change in excitation according to the present invention is able to be realized, in particular, by use of a Zener diode, which lies in series with the switching element. As an alternative, however, it is also possible to connect a controllable comparator in series to the switching element.

According to a further feature of the present invention, a free-wheeling circuit is connected in parallel to the solenoid valve to lower the excitation in the case of a closing interrupt. This free-wheeling circuit includes an adjustable resistor, through which there is the delay performance of solenoid valve excitation.

In accordance with the present invention, to quickly interrupt the solenoid valve, it is possible for the controllable contact element to have a Zener diode that lies between its gate electrode and a breaker-gap connection, enabling the interrupt energy of the solenoid valve to be reduced over a constant voltage. The fast switching performance is drawn upon to initiate the start and end of the injection process.

The magnitude of the closing interrupt is preferably determined by a first time interval and a second time interval in a trigger time of the solenoid valve. As such, the first time interval is dependent upon the pressure relief desired for the injection pressure and the second time interval upon the rotational frequency of the internal combustion engine.

The present invention will be discussed in more detail in the remaining portion of the specification and will be shown in the attached drawings.

BRIEF DESCRIPTION OF THE DRAWINGS

FIG. 9 shows a second embodiment of the trigger circuit of the present invention.

DETAILED DESCRIPTION OF THE DRAWINGS

Figure 1:
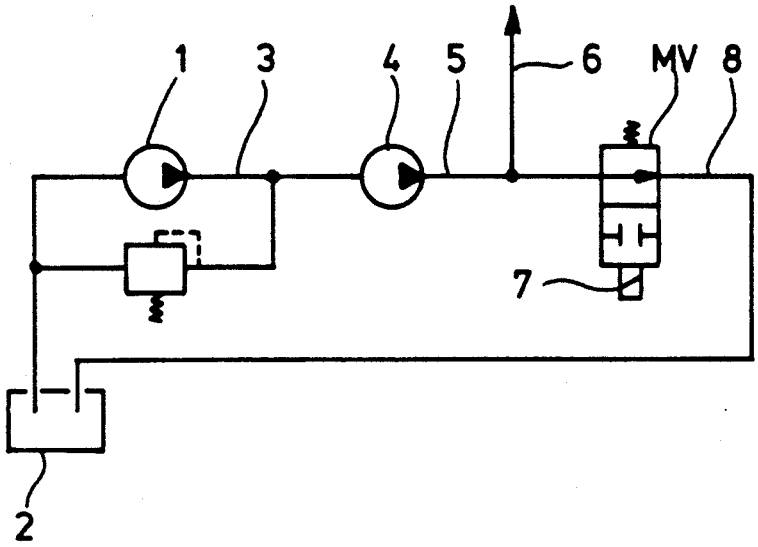
FIG. 1 is a schematic diagram showing control circuitry for an injection device for an internal combustion engine.

FIG. 1 shows an injection device for an internal combustion engine (not shown). The injection device includes a discharge pump 1, which is connected to a fuel tank 2. The outlet 3 of the discharge pump 1 leads to a high-pressure pump 4, whose outlet 5 is connected to an injection line 6. The injection line 6 is also connected to a solenoid valve MV, which can be in a closed position or an open position. The open position is shown in FIG. 1. Both operating states of the solenoid valve MV are able to be brought about by properly exciting a winding 7 of the solenoid valve MV. In the open position, the injection line 6 is connected to line 8 via the solenoid valve MV.

Figure 2:
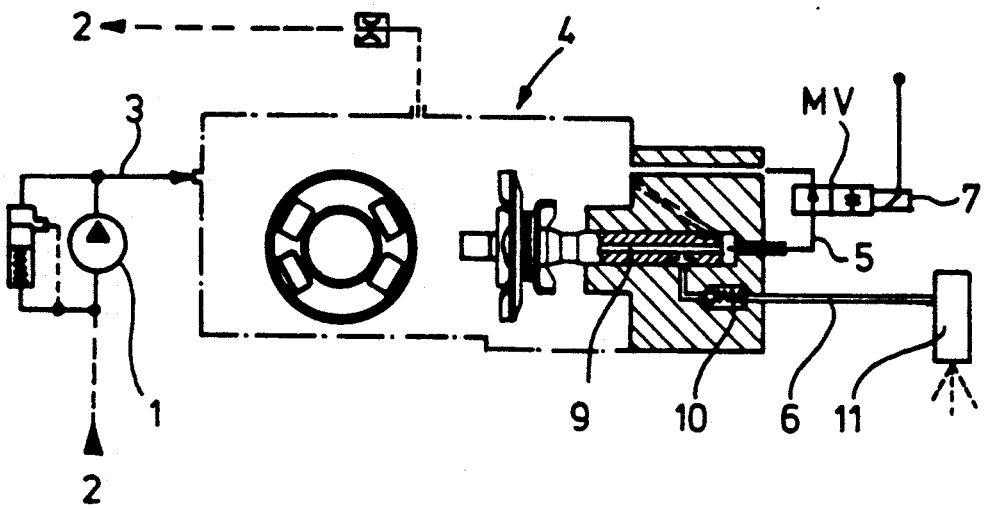
FIG. 2 shows an injection pump that includes the control circuitry shown in FIG. 1.

Referring to FIG. 2, the construction of the high-pressure pump 4 is shown in greater detail. In this Figure, the high-pressure pump is shown in longitudinal section as well as in an end sectional view. A high-pressure chamber 9 of the high-pressure pump 4 is connected via a non-return valve 10 to the injection line 6. An injection nozzle 11 is attached to the end of the injection line 6.

If the high-pressure piston of the high-pressure pump 4 moves into its delivery position, and if the solenoid valve MV is closed, then a corresponding pressure builds up in the high-pressure chamber 9 and in the injection line 6. If this pressure exceeds the nozzle opening pressure of the injection nozzle 11, then a fuel quantity which corresponds to the pressure is injected.

Figure 3:
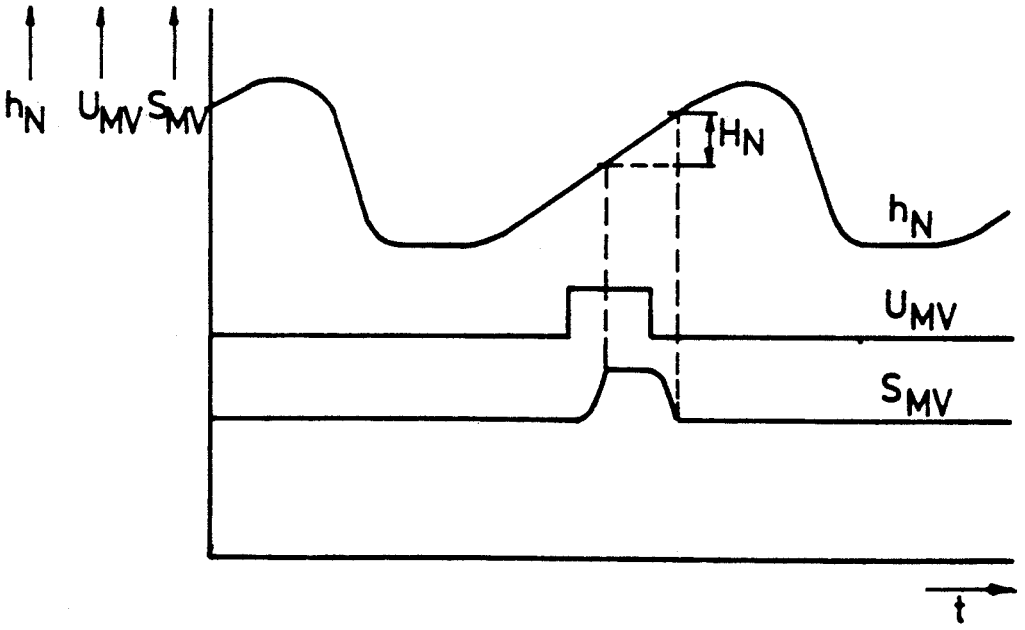
FIG. 3 shows a graph of several engine operating variables.

Referring to FIG. 3, the function of the system shown in FIG. 2 will be described. The lift of cam of the high-pressure pump 4 is shown at the curve labeled $h_N$. The lift of cam $h_N$ corresponds to the height of lift of the high-pressure piston. FIG. 3 shows a control voltage $U_{MV}$, which triggers the winding 7 of the solenoid valve MV. This triggering causes the solenoid valve MV to close. The solenoid valve lift $S_{MV}$ of the closing element of the solenoid valve MV is shown in the lower area of FIG. 3. Due to the build-up of the excitation voltage in the winding 7 of the solenoid valve MV, it becomes clear that when compared to the control voltage $U_{MV}$, the square-wave pulse of the control voltage $U_{MV}$ is rounded accordingly. Thus, in the example of FIG. 3, the amount $H_N$ is provided as an effective height of lift of the high-pressure piston.

Figure 4:
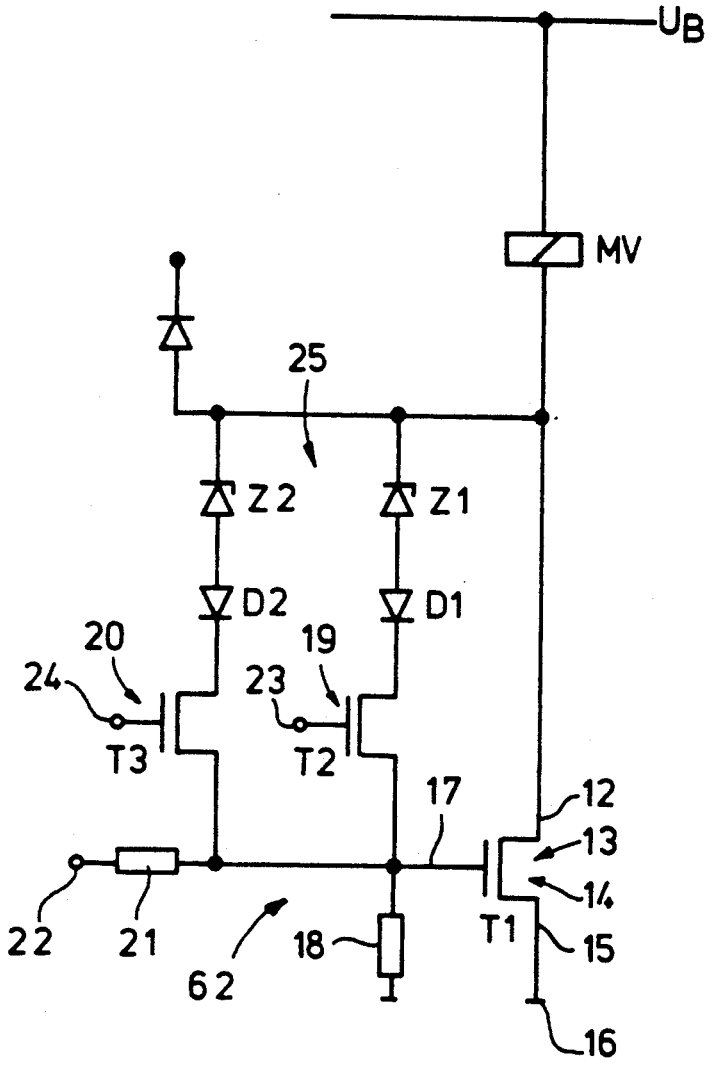
FIG. 4 is a circuit diagram of a trigger circuit of the present invention for triggering an electromagnetic device.
Figure 5:
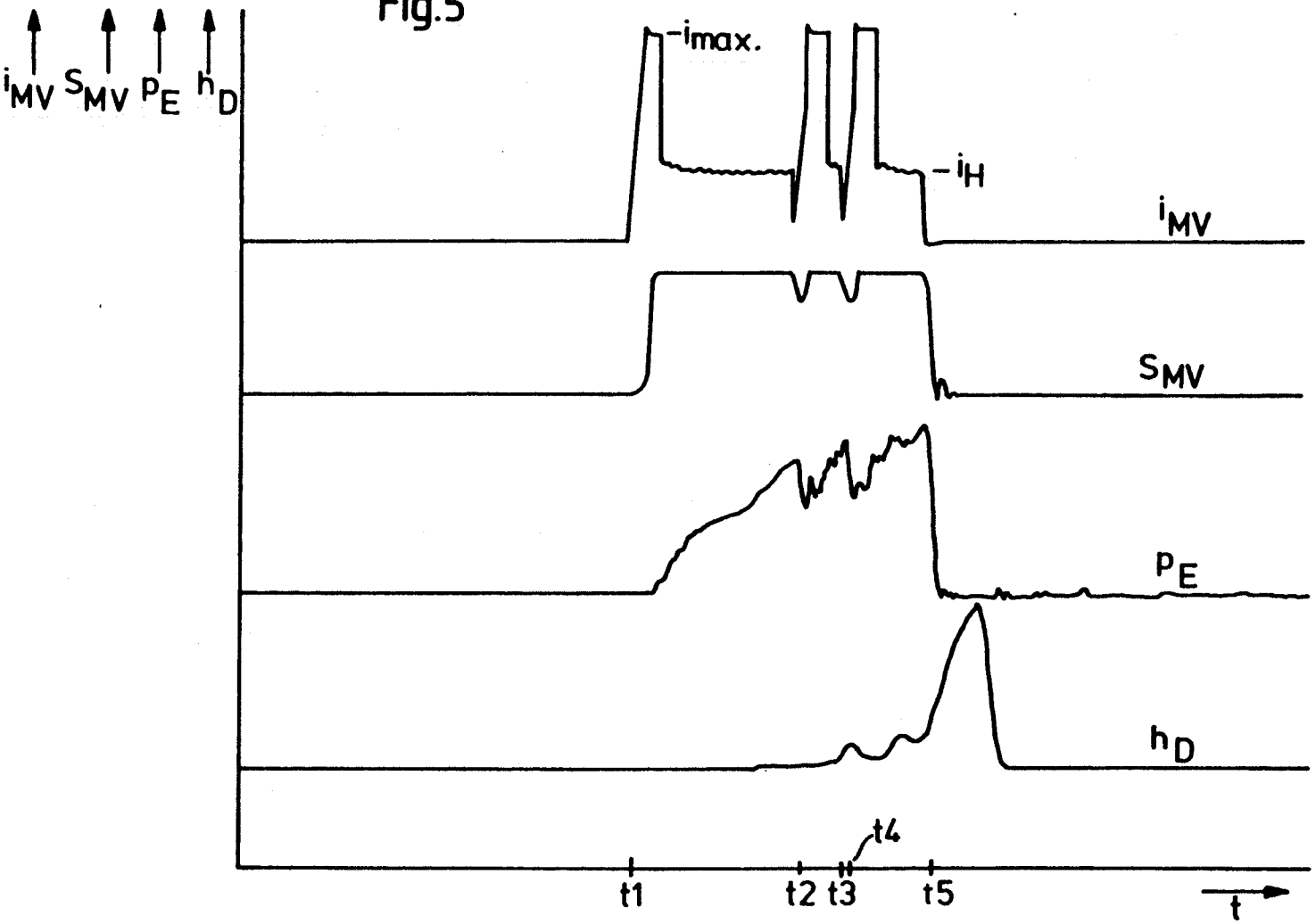
FIG. 5 shows a graph of several engine operating variables.

FIGS. 4 and 5 show a first embodiment of a trigger circuit of the present invention for the solenoid valve MV, as well as corresponding time characteristics for different variables related to the injection device. The solenoid valve MV is excited at the instant t1, which means that the solenoid-valve current $i_{MV}$ begins to flow. The current rises to the maximum value $i_{max}$ and then drops after the desired solenoid valve lift $S_{MV}$ reaches its steady state and holds the value of the current at $i_H$.

From FIG. 5, it can be seen that the pressure $P_E$ in the high-pressure pump 4 rises with time. At the instant t2, the solenoid-valve current $i_{MV}$ drops, resulting in a so-called closing interrupt. This means that the solenoid valve situated in a closed position is displaced for a short time and to a certain degree into an open position, causing the pressure in the injection line 6 to be lowered. In this manner, influence is brought to bear on the injection process. This results in injection characteristic formation.

At the instant t3, a nozzle needle lift $h_D$ rises at the injection nozzle 11. This means fuel is injected. A second closing interrupt is initiated at the instant t4. After this, the nozzle needle lift $h_D$ increases to its maximum value.

At the instant t5, the solenoid-valve current $i_{MV}$ goes back to a 0 value, so that the solenoid valve MV is displaced into its open position. In doing this, there is a corresponding time delay before it is fully opened which signals the end of injection process. The injection process and thus the total injection quantity are able to be influenced by the two closing interrupts shown in FIG. 5.

The present invention provides a trigger-circuit that has a control element for delaying excitation of the solenoid valve MV during closing interrupts. This controls the closing interrupts to obtain a proper injection characteristic formation. This delay circuit changes the excitation method for the solenoid valve MV by causing it to proceed relatively slowly. That is, the solenoid valve MV, which is generally capable of being quickly de-excited or excited, is operated to attain suitable closing interrupt patterns with a diminished rate of change in excitation.

Referring to FIG. 4, the trigger circuit of the present invention will be described. The trigger circuit 62 for the solenoid valve MV has one winding terminal connected to the operating voltage $U_B$. The other winding terminal of the solenoid valve MV is connected to a breaker-gap connection 12 of a breaker gap 13 of a controllable contact element 14. Preferably, the contact element 14 is a transistor T1. The other breaker-gap connection 15 is connected to ground 16. A resistor 18, which leads to ground 16, is connected to a gate electrode 17 of the contact element 14.

A circuit element 19, which is in series with a diode D1 as well as with a Zener diode Z1, is connected to the gate electrode 17. The diode Dl and the Zener diode Z1 are connected in such a way that their anodes are interconnected. The cathode of the Zener diode Z1 is connected to the breaker-gap connection 12 and to the solenoid valve MV. Preferably, the circuit element 19 is a transistor T2.

An additional circuit element 20, which is in series with a diode D2 and a Zener diode Z2, is provided. The breaker-gap of the circuit element 20 is connected to the gate electrode 17 of the transistor T1. The anodes of the diode D2 and the Zener diode Z2 are interconnected. The cathode of the Zener diode Z2 is connected to the breaker-gap connection 12. Preferably, the circuit element 20 is a transistor T3.

A resistor 21 has one terminal that is connected to the gate electrode 17. The other terminal of the resistor forms a gate electrode 22. The bases of the transistors T2 and T3 likewise form gate electrodes 23 and 24, respectively.

To switch in the solenoid valve MV to the closed position, the transistor T1 is triggered via the gate electrode 22. Since solenoid valve MV is a fast-action switching-type MV, a very fast excitation takes place and a solenoid valve lift $S_{MV}$ ensues, thereby closing the solenoid valve. At this point, the high-pressure pump 4 builds up a high pressure in the injection system.

When a closing interrupt is to be produced, the gate electrode 22 is placed at "low", and the gate electrode 23 of the transistor T2 is triggered. Accordingly, the solenoid-valve current $i_{MV}$ is reduced as a result of the avalanche voltage of the Zener diode Z1. The result is a turn-off time that is slowed. That is, the de-excitation of the solenoid valve MV is slowed down.

When the Zener diode Z1 breaks down, the transistor T1 is again triggered. This will mean that the solenoid-valve current $i_{MV}$ assumes a corresponding value and the resulting induced voltage of the solenoid valve MV falls below the avalanche voltage. Thus, the transistor T1 will no longer conduct.

Following this method of providing closing interrupts to form the injection characteristic, slowed changes in excitation of the solenoid valve MV are brought about by means of the delay circuit 25 comprising the transistor T2, the diode D1, and the Zener diode Z1. In a similar fashion, if the gate electrode 24 of the transistor T3 is triggered, then the Zener voltage goes into action by means of the Zener diode Z2, through which means the counter voltage built up by the Zener diode Z2 attains a higher value.

Figure 6B:
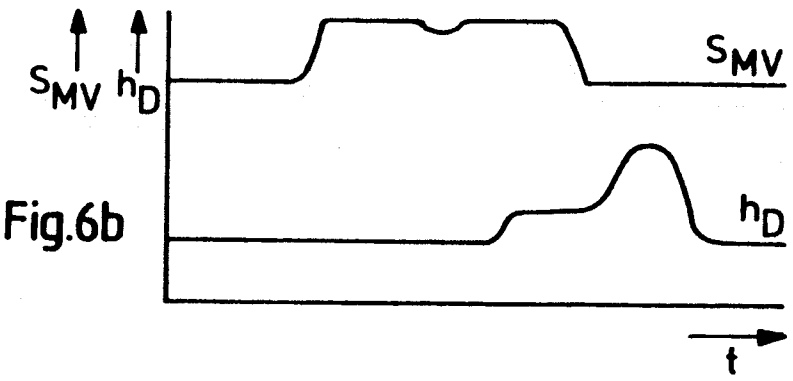
FIGS. 6A and B are characteristic curves of the injection device during idle operation of the internal combustion engine, with FIG. 6A for an injection system that does not incorporate the present invention and FIG. 6B for one that does incorporate the present invention.
Figure 6A:
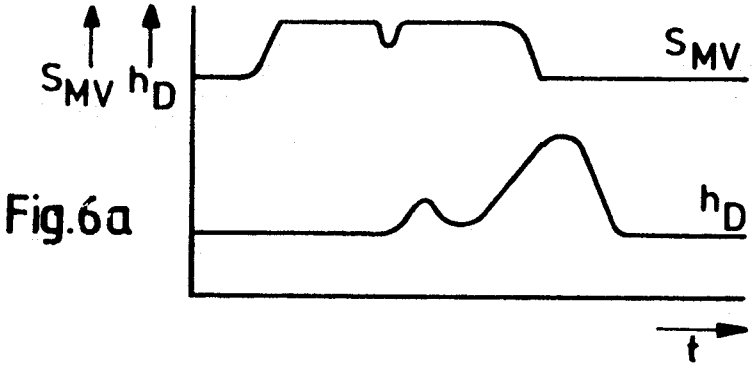
Figure 7B:
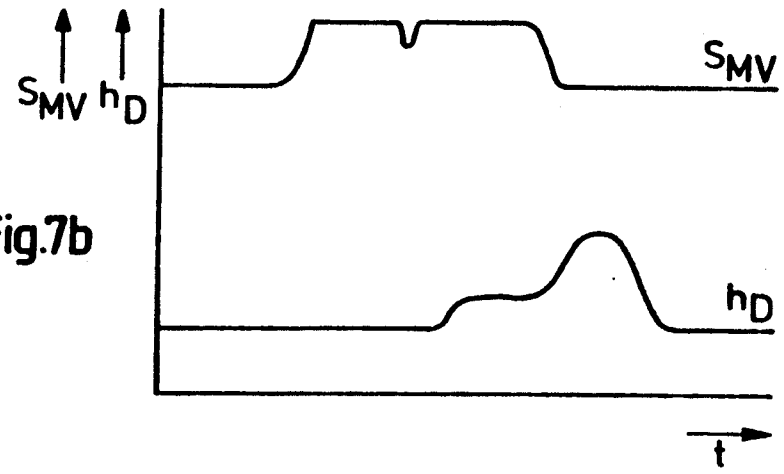
FIGS. 7A and B are characteristic curves of the injection device at the rated speed of the internal combustion engine, with FIG. 7A for an injection system that does not incorporate the present invention and FIG. 7B for one that does incorporate the present invention.
Figure 7A:
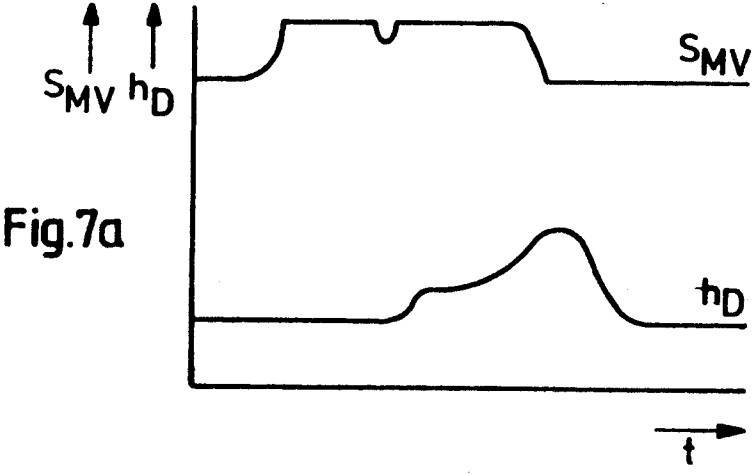

FIGS. 6A and B show diagrams for idle running of an internal combustion engine, and FIGS. 7A and B show diagrams for an internal combustion engine running at a rate speed. In FIG. 6A, a closing interrupt is shown, without slowing of the excitation of the solenoid that is accomplished by the present invention. In this Figure, the solenoid valve lift $S_{MV}$ is shown in the upper part of the diagram. The fast turn-off time of the closing interrupt causes a slump at the nozzle needle lift $h_D$. This means the pressure is relieved too quickly in the pressure chamber of the high-pressure pump 4. If one compares FIGS. 6A and B, it is seen in FIG. 6B that the closing interrupt is slowed in accordance with the present invention. This provides a properly adapted solenoid-valve turn-off time, and the desired injection characteristic results. More particularly, this is an injection characteristic formation, with which a high metering accuracy is attained for the total injection quantity.

FIGS. 7A and 7B show corresponding characteristics at a rated speed of the internal combustion engine. The present invention is not applied in FIG. 7A while it is in FIG. 7B. It is seen in FIG. 7A that the pressure chamber of the high-pressure pump 4 is relieved slowly, which means that the nozzle needle lift $h_D$ is going up too quickly. However, referring to FIG. 7B if there is a very fast closing interrupt, and thus a corresponding release of pressure is brought about, then the desired injection characteristic follows which is in accordance with the present invention.

Figure 8:
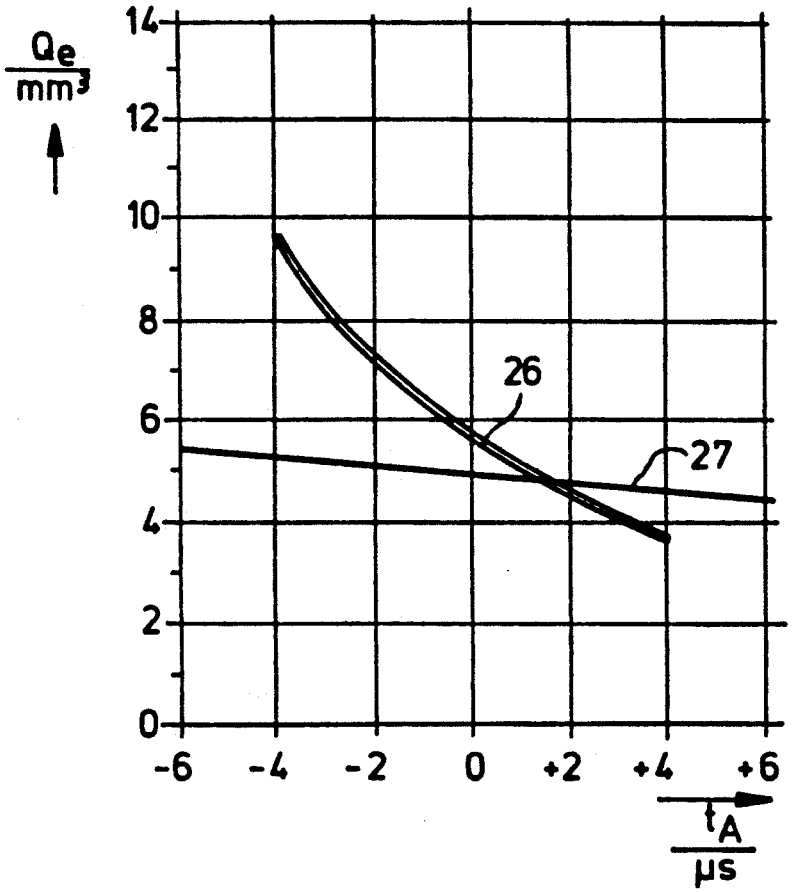

FIG. 8 shows the relationship between trigger time $t_A$ of the solenoid valve MV and the fuel injection quantity $Q_e$. Moreover, this Figure shows how the trigger time $t_A$ of the solenoid valve MV for a closing interrupt influences the fuel injection quantity $Q_e$. As is seen in FIG. 8, small variations in the trigger time $t_A$ at the characteristic curve 26 lead to considerable changes in injection quantities. This has a drastic effect on the metering accuracy. The characteristic curve 26 applies to injection devices that do not use the present invention.

If, however, the change of excitation of the solenoid valve MV is slowed by use of the present invention, the characteristic curve 27 results. Characteristic curve 27 shows that changes in the trigger time $t_A$ do not result in drastic injection quantity changes. That is, the injection quantity $Q_e$ is able to be varied quasi linearly. Accordingly, depending upon the rotational frequency and also upon other parameters of the internal combustion engine, the desired formation of the injection characteristic can follow, without the turn-on and turn-off time variances, which are dependent on the solenoid valve MV, having a decisive effect on the metering accuracy of the injection system.

Figure 9:
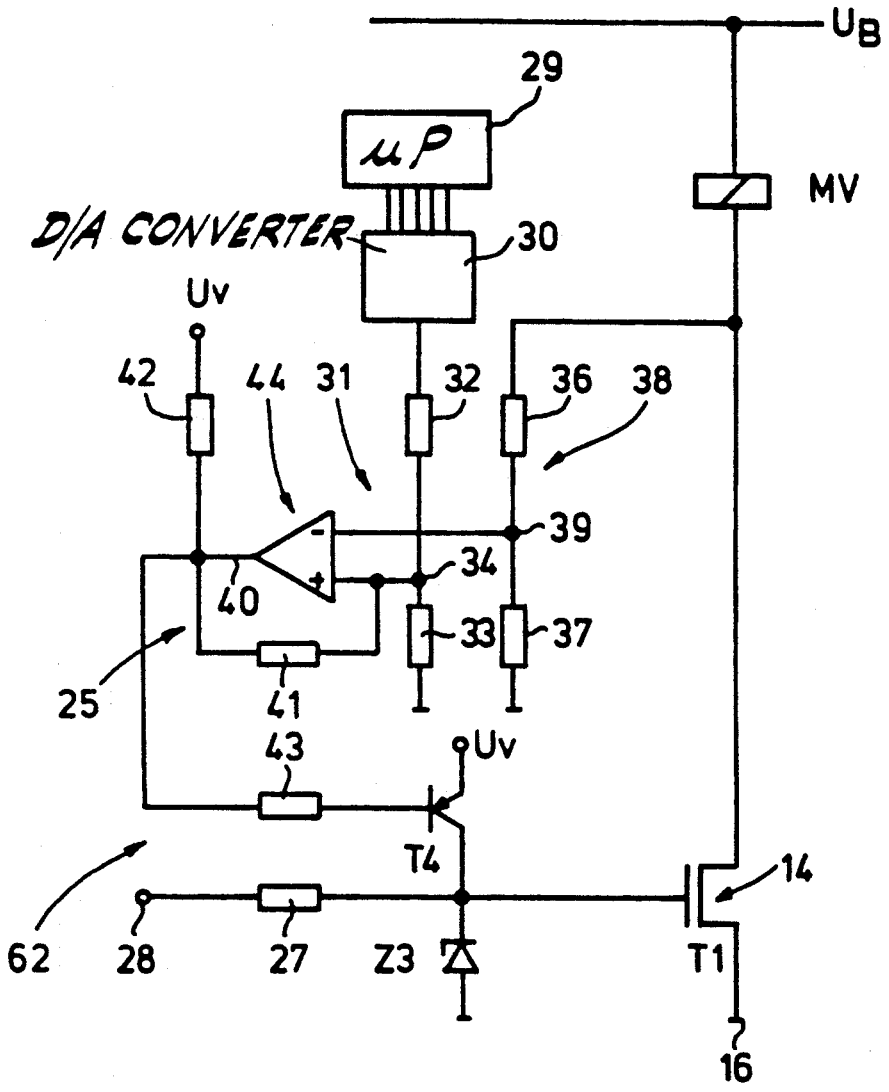
FIG. 9 is a graph which shows the influence of a trigger time for a solenoid valve of the injection device on the injected fuel quantity.

FIG. 9 shows a second embodiment of a trigger circuit of the present invention for triggering the solenoid valve MV. In this embodiment, the solenoid-valve turn-off time is steplessly controllable. The solenoid valve MV has one winding terminal connected to the operating voltage $U_B$ while the other winding terminal is connected to the contact element 14. Preferably, the contact element 14 is a transistor T1. The base of the transistor T1 is connected to a gate electrode 28 via a resistor 27. A Zener diode Z3 is connected between the base of the transistor T1 and the ground 16.

A microprocessor 29 is connected to a digital-to-analog converter 30. The digital-to-analog converter 30 connects to a voltage divider 31. The voltage divider 31 comprises of the resistors 32 and 33. The center tap 34 of the voltage divider 31 is connected to the non-inverting input 34 of a comparator 44.

A second voltage divider 38 is provided which comprises resistors 36 and 37. One terminal of voltage divider 38 connects a terminal of the solenoid valve MV and the other terminal of the voltage divider 38 is connected to ground 16. The center tap 39 of the voltage divider 38 leads to the inverting input of the comparator 44.

The output 40 of the comparator 44 connects to a feedback loop that includes resistor 41. The feedback loop connects to the non-inverting input of the comparator 44.

The second embodiment of the trigger circuit also has a supply voltage $U_v$ that connects to the output 40 of the comparator 44 via resistor 42. The output 40 of the comparator 44 further is connected via a resistor 43 to the base of a transistor T4. The emitter of the transistor T4 connects to the supply voltage $U_v$ and the collector of the transistor T4 is connected to the base of the transistor T1.

The digital-to-analog converter 30 is triggered based on various parameters of the internal combustion engine which are processed by the microprocessor 29. This digital-to-analog converter 30 supplies a corresponding control voltage, which sets the switching threshold of the comparator 44. With the aid of the comparator 44, the maximum induced voltage of the solenoid valve MV is influenced when it is interrupted with a closing interrupt.

Voltage-control or current-control circuits (not shown) can be provided. These additional circuits may help influence the pick-up times of the solenoid valve MV.

Figure 10:
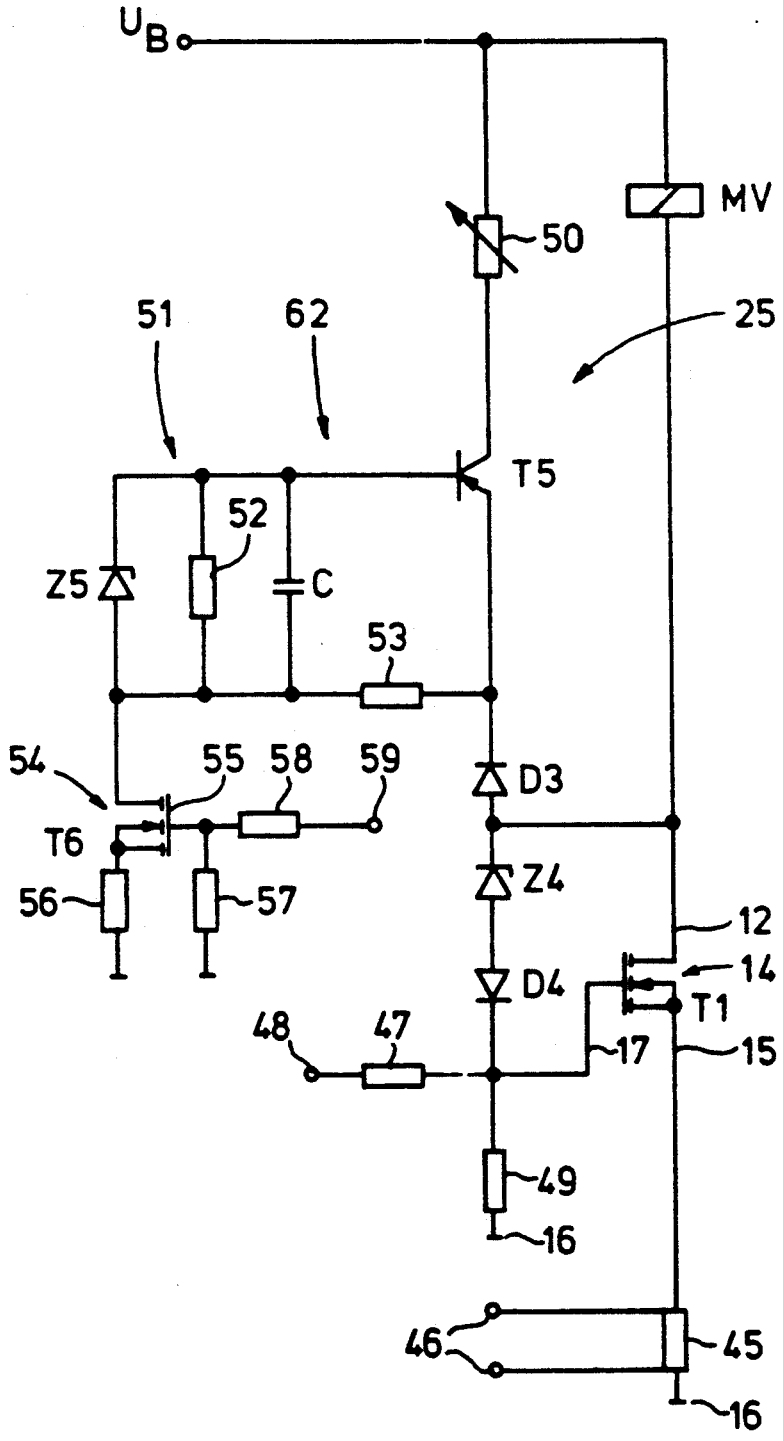
FIG. 10 shows a third embodiment of the trigger circuit of the present invention.

FIG. 10 shows a third embodiment of a trigger circuit of the present invention. By employing this embodiment, the closing interrupts can be steplessly specified depending on rotational frequency, load, and other parameters of the internal combustion engine. According to FIG. 10, the solenoid valve MV has one winding terminal that connects to the operating voltage $U_B$. The other winding terminal connects to the breaker-gap connection 12 of the contact element 14, which preferably is a transistor T1. The other breaker-gap connection 15 of the contact element 14 is connected to ground 16 via a shunt 45. For further processing, the shunt voltage can be picked off at terminals 46.

The gate of the transistor T1 is connected to a gate electrode 48 via resistor 47. The gate is connected also to ground 10 via a resistor 49.

A variable resistor 50 has one terminal connected to the operating voltage $U_B$ and the other terminal to a collector of a transistor T5. The emitter of the transistor T5 via a diode D3 to the breaker-gap connection 12. The breaker-gap connection 12 is connected via a Zener diode Z4 and diode D4 to the base of the transistor T1. The connection is such that the cathode of the diode D3 is connected to the emitter of the transistor T5 and the cathode of the diode D4 to the gate of the transistor T1. Furthermore, the anodes of the diode D4 and the Zener diode Z4 are interconnected.

A Zener diode Z5, a resistor 52, and a capacitor C are connected in parallel. The parallel connected elements have a terminal connected to the base of the transistor T5 and the other terminal to the emitter of the transistor T5 via a resistor 53. The cathode of the Zener diode Z5 is connected to the gate of the transistor T5. The anode of the Zener diode Z5 is connected to the breaker gap 54 of a circuit element 55, which preferably is a transistor T6. The other terminal of the breaker gap 54 is connected to ground 16 via a resistor 56. The gate of the transistor T6 is connected to ground 16 via a resistor 57. A resistor 58 also is provided, which has one terminal connected to the gate of the transistor T6 and the other terminal connected to a gate electrode 59.

To achieve a fast closing interrupt for the solenoid valve MV, the gate electrodes 48 and 59 are connected to 0 voltage, in other words to the potential of the ground 16. When this take place, the transistors T1, T5, and T6 assume their non-conductive states. If the voltage across the transistor T1 exceeds the Zener break down voltage stipulated by the Zener diode Z4, then the transistor T1 becomes conductive. The energy of the winding of the solenoid valve MV is converted through the constant voltage. The solenoid valve current $i_{MV}$ decreases nearly linearly.

To achieve a slow closing interrupt for the solenoid valve MV, in other words to slowly reduce the coil current, it is necessary to trigger the gate electrode 59 with a high signal and the gate electrode 48 with a low signal (ground). As a result, the solenoid valve current $i_{MV}$ flows across the transistor T5 and decreases approximately as an e-function. The time constant can be adjusted by means of the variable resistor 50.

Figure 11:
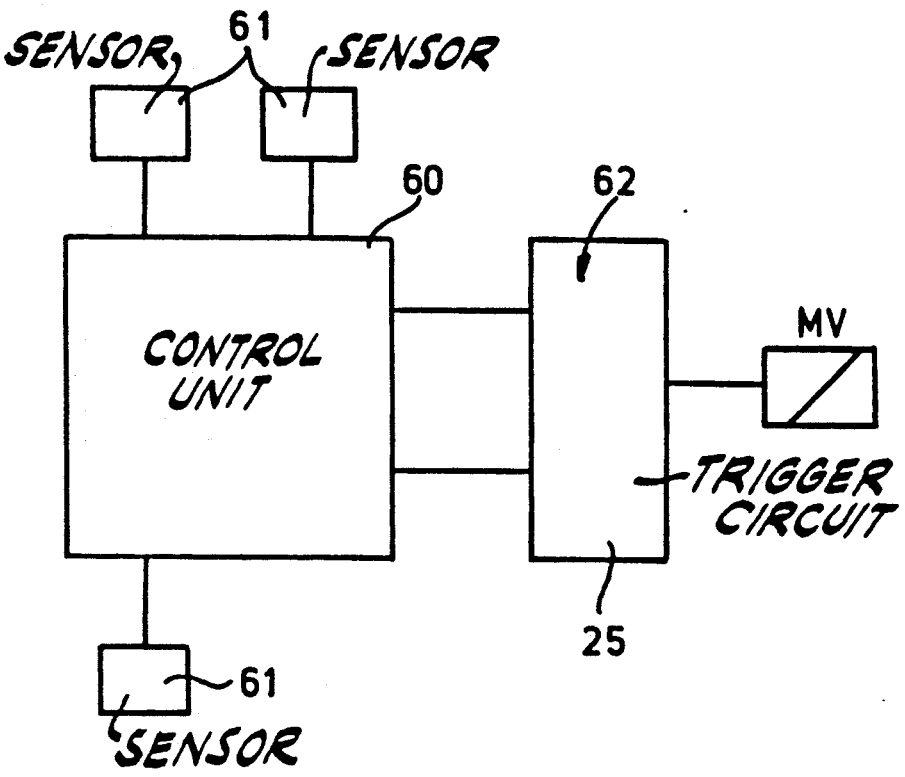
FIG. 11 a block diagram of a system including the trigger circuit of the present invention.

The block diagram of FIG. 11 is illustrated of the present invention disposed in a motor vehicle. The Figure shows a control unit 60, which is supplied via sensors or the like 61 with various parameters characterizing the operating state of the internal combustion engine. These parameters can be, for example, gas pedal position, rotational frequency, crankshaft and camshaft position, and temperature values. The control unit 60 is connected to the trigger circuit 62 of the present invention, which operates the solenoid valve MV in the appropriate, desired manner as has been set forth above.

Preferably, the closing time of the solenoid valve MV is able to be controlled discretely or steplessly. The injection system of the internal combustion engine may be relieved, in the case of a closing interrupt, by a specific pressure value, then the trigger period of the solenoid valve for the closing interrupt is determined from a time interval corresponding to the desired relieving action and from a time interval which is proportional to the rotational frequency of the internal combustion engine. The other most important factors which influence the trigger time for the closing interrupt are the desired injection characteristic, compressional vibrations in the injection system, temperature, as well as injection quantity.

We claim:

1. A trigger circuit for triggering an electromagnetic device capable of being rapidly de-excited and excited, comprising:

a first control element coupled to the electromagnetic device for causing excitation of the electromagnetic device when activated; and excitation control means coupled to the first control element for decreasing a rate at which the electromagnetic device is de-excited and then excited during a predetermined period of time.

2. The trigger circuit as recited in claim 1, wherein the electromagnetic device includes a solenoid valve.

3. The trigger circuit as recited in claim 1, wherein the electromagnetic device is connected in series with the first control element.

4. The trigger device as recited in claim 3, wherein the first control element includes a first transistor.

5. The trigger circuit as recited in claim 4, wherein the excitation control means is connected to the gate and a breaker-gap of the first transistor.

6. The trigger circuit as recited in claim 5, wherein the excitation control means further includes a switching element.

7. The trigger circuit as recited in claim 6, wherein the switching element includes a first and a second switching portion that are connected in parallel.

8. The trigger circuit as recited in claim 7, wherein the first switching portion includes a first Zener diode, a first diode, and a second transistor connected in series.

9. The trigger circuit as recited in claim 7, wherein the second switching portion includes a second Zener diode, a second diode, and a third transistor connected in series.

10. The trigger circuit as recited in claim 6, wherein the switching element includes a comparator and a fourth transistor, with a first input to the comparator being connected to the electromagnetic device and a second input being connected to a source of a control voltage, and an emitter of the fourth transistor being connected to a supply voltage and a collector of the fourth transistor being connected to the gate of the first transistor.

11. A trigger circuit for triggering a solenoid valve capable of being rapidly de-excited and excited, comprising:

a first transistor connected in series with the solenoid valve for causing excitation of the solenoid valve when activated;

excitation control means connected to the gate and a breaker-gap of the first transistor for controlling a rate at which excitation of the solenoid valve is lowered and then raised during a predetermined period;

wherein the excitation control means includes a switching element which includes a first circuit section for controlling excitation and de-excitation of the solenoid valve at a first rate and a second circuit section for controlling excitation and de-excitation of the solenoid valve at a second rate.

12. The trigger circuit as recited in claim 11, wherein the first circuit section includes a series connected first Zener diode and first diode.

13. The trigger circuit as recited in claim 11, wherein the second circuit section includes a freewheeling circuit.

14. The trigger circuit as recited in claim 13, wherein the freewheeling circuit further comprises a series connected voltage adjustment means, second transistor, and the first diode.

15. A method for triggering an electromagnetic device, comprising the steps of:

applying a voltage to a series connected electromagnetic device and first control element, with the first control element being in an off-condition and correspondingly the electromagnetic device being in an open state;

switching the first control element to an on-condition and exciting the electromagnetic device to move to a closed state; and interrupting the excited condition of the electromagnetic device at least once by de-exciting and then exciting the electromagnetic device with an excitation control means which decreases a rate at which excitation of the electromagnetic device changes during de-excitation and excitation.

16. The method as recited in claim 15, wherein at the interrupting step the magnitude of the interrupt is determined by first and second time intervals in a trigger time of the control element, with the first time interval being dependent on a first predetermined parameter and the second time interval being dependent on a second predetermined parameter.

* * * * *